US006935148B2

(12) United States Patent
Don

(10) Patent No.: US 6,935,148 B2
(45) Date of Patent: Aug. 30, 2005

(54) LOCK ENGAGING-AND-DISENGAGING MECHANISM

(75) Inventor: Lan-Kun Don, Chiayi (TW)

(73) Assignee: Tung Lung Metal Industry Co., Ltd., Chiayi (TW)

( * ) Notice: Subject to any disclaimer, the term of this patent is extended or adjusted under 35 U.S.C. 154(b) by 0 days.

(21) Appl. No.: 10/626,422

(22) Filed: Jul. 24, 2003

(65) Prior Publication Data

US 2004/0144143 A1 Jul. 29, 2004

(30) Foreign Application Priority Data

Jul. 29, 2002 (CN) ..... 91211651 U

(51) Int. Cl.[7] ..... E05B 55/04
(52) U.S. Cl. ..... 70/472; 70/224
(58) Field of Search ..... 70/149, 221–224, 70/472

(56) References Cited

U.S. PATENT DOCUMENTS 5,040,652 A * 8/1991 Fish et al. ..... 70/189
5,768,926 A * 6/1998 Shen ..... 70/472
5,784,909 A * 7/1998 Huang ..... 70/224
5,794,472 A * 8/1998 Kester et al. ..... 70/472
5,868,018 A * 2/1999 Kang ..... 70/472
5,934,117 A * 8/1999 Shen ..... 70/224
5,941,108 A * 8/1999 Shen ..... 70/467
6,038,894 A * 3/2000 Hu ..... 70/224
6,105,407 A * 8/2000 Yao ..... 70/472
6,357,270 B1 * 3/2002 Vazquez ..... 70/472
6,540,274 B2 * 4/2003 Bates et al. ..... 292/336.5
6,575,006 B1 * 6/2003 Don ..... 70/472
6,626,018 B2 * 9/2003 Eller et al. ..... 70/224
6,742,367 B2 * 6/2004 Wu ..... 70/224
2001/0023600 A1 * 9/2001 Pompeii ..... 70/224

* cited by examiner

*Primary Examiner*—Suzanne Dino Barrett
(74) *Attorney, Agent, or Firm*—Senniger Powers

(57) ABSTRACT

A lock engaging-and-disengaging mechanism, having: a driving tube, containing at least one hole on the inner wall of the tube, and a key driven tube, flexibly installed to the inner tube portion of the first end of the driving tube, and containing at least one hole on the wall of the tube; a sideway component, being installed in the hole on the key driven tube, and allowing the options of engaging or disengaging with the hole on the driving tube, an axially sliding component being inserted inside the key driven tube and having a non-axial slot, a rotatable component is inserted inside the axially sliding component, the rotatable component containing a pin dipping into the non-axial slot of the axially sliding component on rotation of the rotatable component, enabling movement of the pin of the axially sliding component and the non-axial slot of the axially sliding component so as to make the axially sliding component generate axial displacement in order to control the movement of the sideway component that is installed on the key driven tube.

2 Claims, 7 Drawing Sheets

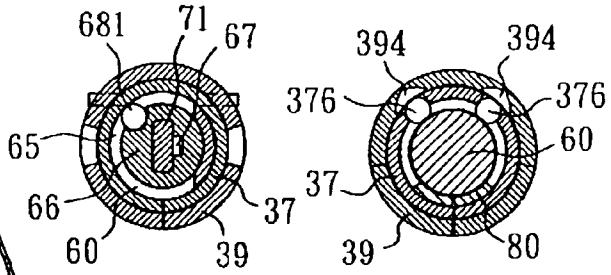
FIG. 6
FIG. 7
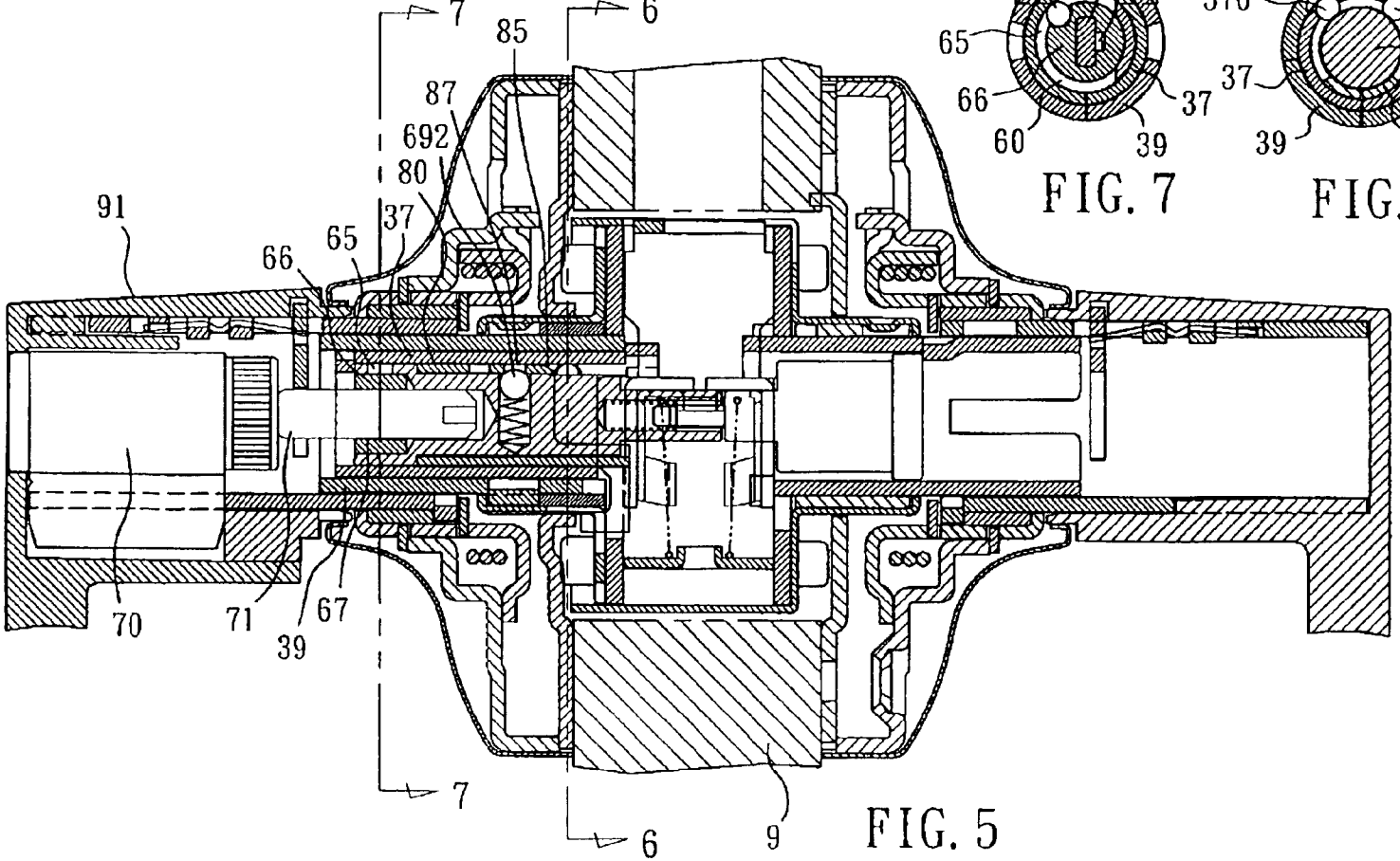
FIG. 5

LOCK ENGAGING-AND-DISENGAGING MECHANISM

BACKGROUND OF THE INVENTION

1. Field of the Invention

The present invention refers to a lock engaging-and-disengaging mechanism, particularly a lock engaging-and-disengaging mechanism that can be directly operated by a key lock.

2. Description of Prior Art

The structure of ordinary cylindrical locksets of the prior art is illustrated in FIG. 1, roughly comprising an inside and outside handles A, B and a case set E. Each of the inside and outside handles A, B is connected to one end of an inner and outer driving tube C, D, respectively. The case set E contains therein a spring mechanism F which can be driven by ends C', D' opposite to the inner and outer driving tubes C, D so as to operate the latch installed onto the door. The inside of the outer driving tube D bears a lockset which can be operated by a key. The operation of the lockset by the key can drive a key driven tube inside the outer driving tube D. The key driven tube comprises a driving wing G. The rotation of the driving wing G drives a pull-retract mechanism F to prompt the latch installed onto the door.

Conventional cylindrical locksets as stated above use a key to operate the key driven tube which in turn drives the pull-retract mechanism F to withdraw the head portion of the latch. When the lock is locked, its outside handle is easily damaged due to the limitations of the inner structure of the lockset.

SUMMARY OF THE INVENTION

To eliminate the above problem, the present invention provides a lock which handle can be rotated a predetermined angle when it is locked. This is advantageous because the force imposed on the locked lock will not damage the internal lock structure. Accordingly, the main purpose of the present invention is to provide a lock engaging-and-disengaging mechanism that allows the handle of the lock to provide an idle rotation for a preset angle when the lock is locked.

To achieve the above objective, this invention discloses a lock engaging-and-disengaging mechanism, comprising:

a driving tube shaped into a hollow tubular body, said driving tube comprising a first end and a second end, wherein said first end is installed to the inside of the locking mechanism and said second end is connected to a handle or a connecting element or the like of a handle, said driving tube further comprising at least one tapering hole (or recess/indent) on the inner wall of said driving tube;

a key driven tube shaped into a hollow tubular body, said key driven tube being flexibly installed to an inner tube portion of the first end of said driving tube, wherein a wall of said key driven tube is formed with at least one hole in alignment with the tapering hole on the inner wall of said driving tube;

a sideway component, which is installed in said at least one hole of said key driven tube and either engaged or disengaged with the tapering hole or recess of said driving tube;

an axially sliding component for insertion into the key driven tube, said axially sliding component comprising a first end, a second end, and a non-axial slot (or an inclining slot) between said first end and said second end;

a rotatable component for insertion into said axially sliding component, said rotatable component comprising a first end, a second end, and a pin between said first end and said second end, wherein said pin extends into the non-axial slot of said axially sliding component;

whereby the rotation of said rotatable component enables the pin of said axially sliding component to co-work with the non-axial slot of said axially sliding component, such that the axially sliding component can shift axially between the first position and the second position; and that when said axially sliding component is moved to the first position, said at least one hole of said key driven tube corresponds to said at least one tapering hole of said driving tube, and that when said sideway component is placed at the first end near said axially sliding component to allow said driving tube to rotate with respect to said key driven tube, said sideway component is disengaged from the tapering holes of said driving tube and thereby the key driven tube is disengaged from said driving tube; and when said axially sliding component is located at the second position, said sideway component is engaged with the holes of said key driven tube and the tapering holes of said driving tube, and is abutted against the outer rim of the first end of said axially sliding component, this allowing said key driven tube to be engaged with said driving tube such that the key driving tube is rotated because of the rotation of said driving tube.

The structures and characteristics of this invention can be realized by referring to the appended drawings and explanations of the preferred embodiments.

BRIEF DESCRIPTION OF THE DRAWINGS

FIG. 5 is a cross-sectional view taken along line 5—5 of FIG. 4 (without the latch), showing that the door panel transmission component is at a first position.

FIG. 6 is a partial cross-sectional view taken along line 6—6 of FIG. 5, showing the interrelationship among the outer driving tube, key driven tube, axially sliding component, rotatable component, and the sideway component, in which the present invention is installed onto the door panel with the sideway component being located at the first position;

FIG. 7 is a partial cross-sectional view taken along line 7—7 of FIG. 5, in which the connecting part is located at first position;

DETAILED DESCRIPTION OF PREFERRED EMBODIMENT

Figure 1:
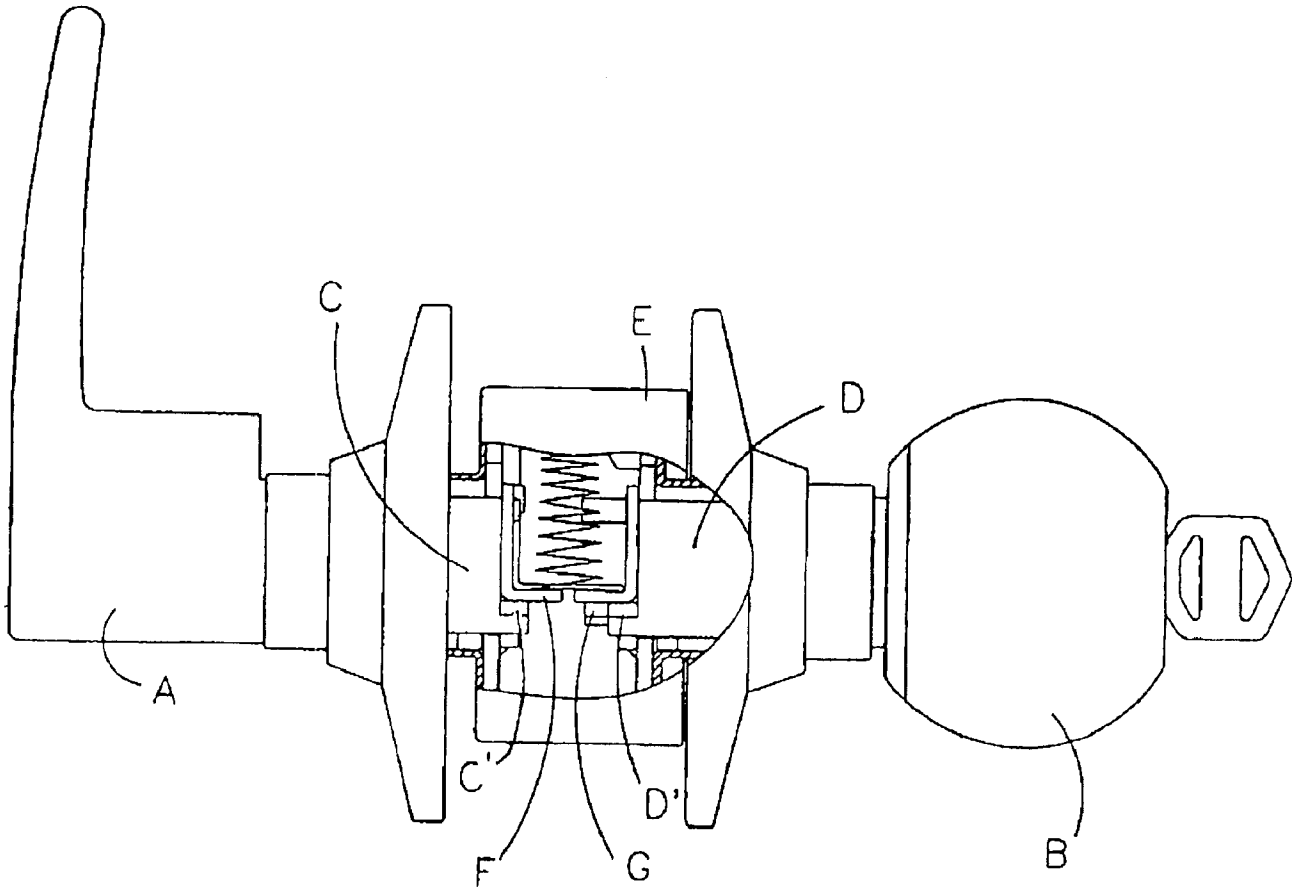
FIG. 1 (PRIOR ART)
FIG. 1 is a partial cross-sectional view of a prior art lock.
Figure 2:
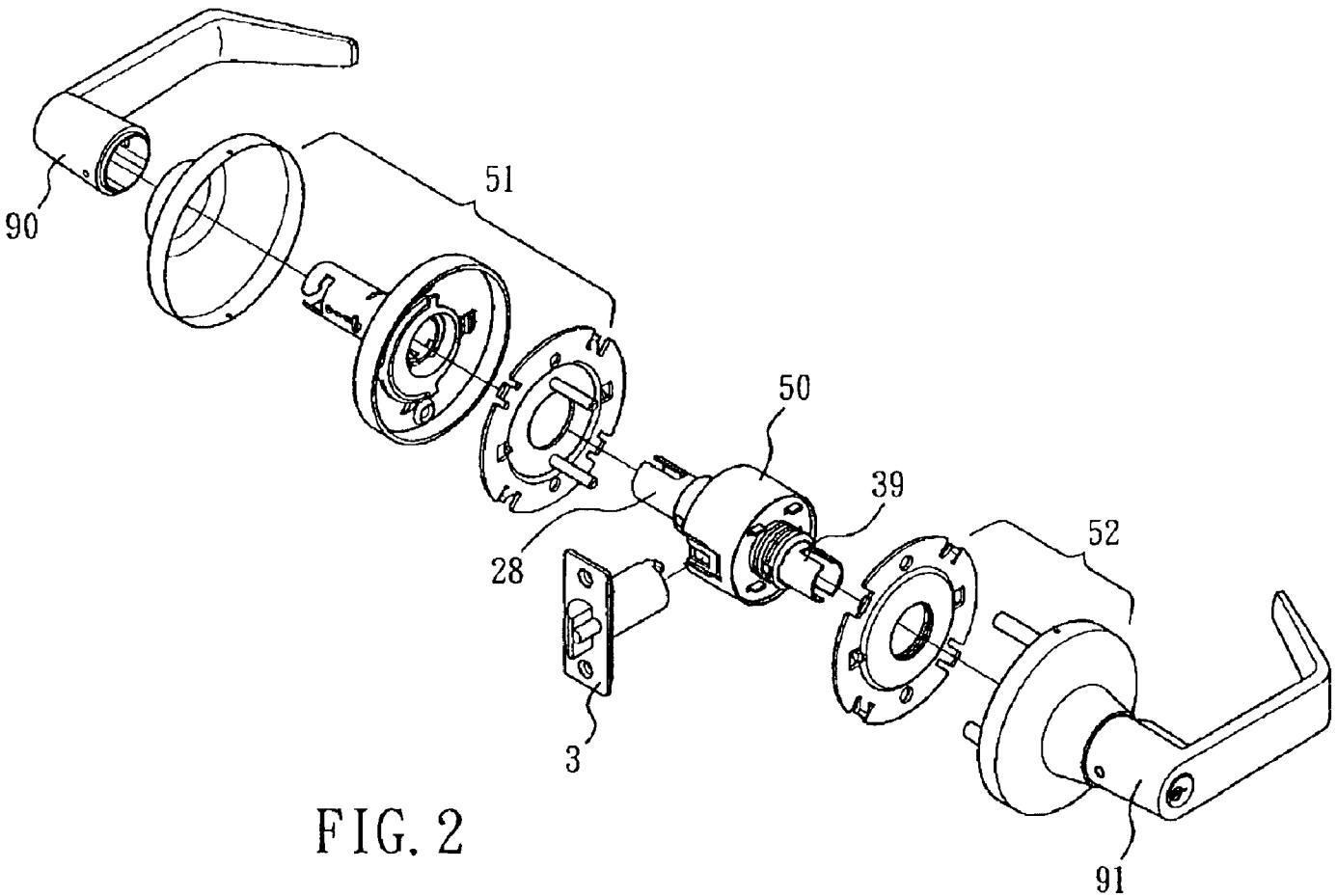
FIG. 2 is an exploded view showing a first preferred embodiment of the present invention.

The lock engaging-and-disengaging mechanism of a first preferred embodiment of the present invention can be installed to a conventional lock. As illustrated in FIGS. 2–7, the lock engaging-and-disengaging mechanism substantially comprises: a lock mechanism (50) capable of driving a latch (3), and an inside and an outside case set (51, 52) capable of firmly clamping said lock mechanism (50) onto the door, wherein the lock mechanism (50) comprises a cylindrical housing (26), an inner and an outer pull-retract plate (30, 36), a shield (34), a pull-retract device (31), and a sleeve (35). The lock engaging-and-disengaging mechanism can pull the pull-retract device (31) of the latch (3) into the cylindrical housing (26) and can provide the retraction force by springs (33).

The inner driving tube (28) is shaped into a hollow tubular body and comprises a first end (281) and a second end (282), wherein the first end (281) is adaptable for driving the pull-retract device (31). The first end (281) is received in an inside stabilizing cover (27) such that the inner driving tube (28) can be stably rotated in a thru hole (261) of the cylindrical housing (26). A positioning part (600) having a connecting portion (630) is received in the first end (281). The second end (282) of the inner driving tube (28) can be mounted to an operating component, such as an inside handle (90) or a connecting element or the like of an inside handle (shown in FIG. 2).

The invention is particularly characterized in a lock engaging-and-disengaging mechanism. Substantially, the mechanism comprises a key driven tube (37) and an outer driving tube (39), which will be explained below.

The outer driving tube (39) shapes into a hollow tubular body and comprises a first end (391) and a second end (392). The first end (391) is received in an outside stabilizing cover (270) and thereby coupled to the sleeve (35). The outer driving tube (39) comprises a pair of radially-spaced-apart projections (393) (only one of which is shown) on an outer wall thereof to provide positioning effects. The second end (392) of the outer driving tube (39) can be mounted to an operating component, such as an outside handle (91) or a connecting element or the like of an outside handle (shown in FIG. 2).

The key driven tube (37) shapes into a hollow tubular body with an outer diameter that is slightly smaller than an inner diameter of the outer driving tube (39) such that it can be received in the outer driving tube (39). The key driven tube (37) comprises a first end (371) and a second end (372). The first end (371) comprises a pair of driving wings (373) for driving the pull-retract device (31), so as to release the latch (3) coupled to the pull-retract device (31) such that a door (9) can be opened. The second end (372) of the key driven tube (37) includes a radially opposite pair of inward projections (374). A rotatable component (60) having a first end (61) and a second end (62) is received in the key driven tube (37). The first end (61) has an axially-extending connecting portion (63) for coupling to the connecting portion (630) of the positioning part (600). A spring is provided between the connecting portions (63, 630) to maintain the position of the rotatable component (60). The second end (62), which is adjacent the projection (374), is formed with an axial opening (64). An arcuate slot (65), which is formed on the peripheral wall of the second end (62), communicates with the axial opening (64). A connecting part (66) formed with a thru hole (67) is received in the axial opening (64). A pin (681) in a steel ball-form or a key-form (in the drawings, a steel ball-form of pin is illustrated) laterally extends from the connecting part (66), which is inserted into the arcuate slot (65) of the rotatable component (60). An operating element (71) of a lockset (FIG. 5) can be inserted into the thru hole (67) of the connecting part (66) mounted in an outside handle (91) and installed thereto. By inserting a key (not shown in the drawings) into the lockset (70), a user can operate the operating element (71) to allow the connecting part (66) to be rotated between a first position and a second position, and thereby the rotatable component (60) can be rotated for a preset angle. An axially sliding component (80), which is shaped into a hollow tubular body, receives the first end (61) of the rotatable component (60). By this way the axially sliding component (80) is installed in the key driven tube (37). The axially sliding component (80) comprises a first end (81), a second end (82), an extending portion (83) longitudinally extending from a wall of the first end (81), and a positioning wing (84) radially extending from the extending portion (83). The positioning wing (84) is coupled to the positioning hole (361) of the outer pull-retract plate (36), so as to keep the axially sliding component (80) moving along an axial direction. The axially sliding component (80) further comprises a guiding surface (85) (shaped with inclining surfaces or the like) around the peripheral wall of the first end (81), and a non-axial slot (i.e., an inclining slot that does not extend along an axial direction of the axially sliding component (80)) (86) on a wall section between the first and second ends (81, 82).

Referring to the rotatable component (60), it further comprises a pin (68) (preferably having a steel ball end) or the like between the first end (61) and the second end (62), and a hole (69) near the pin (68) for the installation of a spring (691) and a steel ball (692) therein. The pin (68) is fit in the non-axial slot (86) of the axially sliding component (80). The axially sliding component (80) further comprises spaced-apart holes (87) (only one of which is shown in FIG. 3) adjacent the non-axial slot (86).

Figure 3:
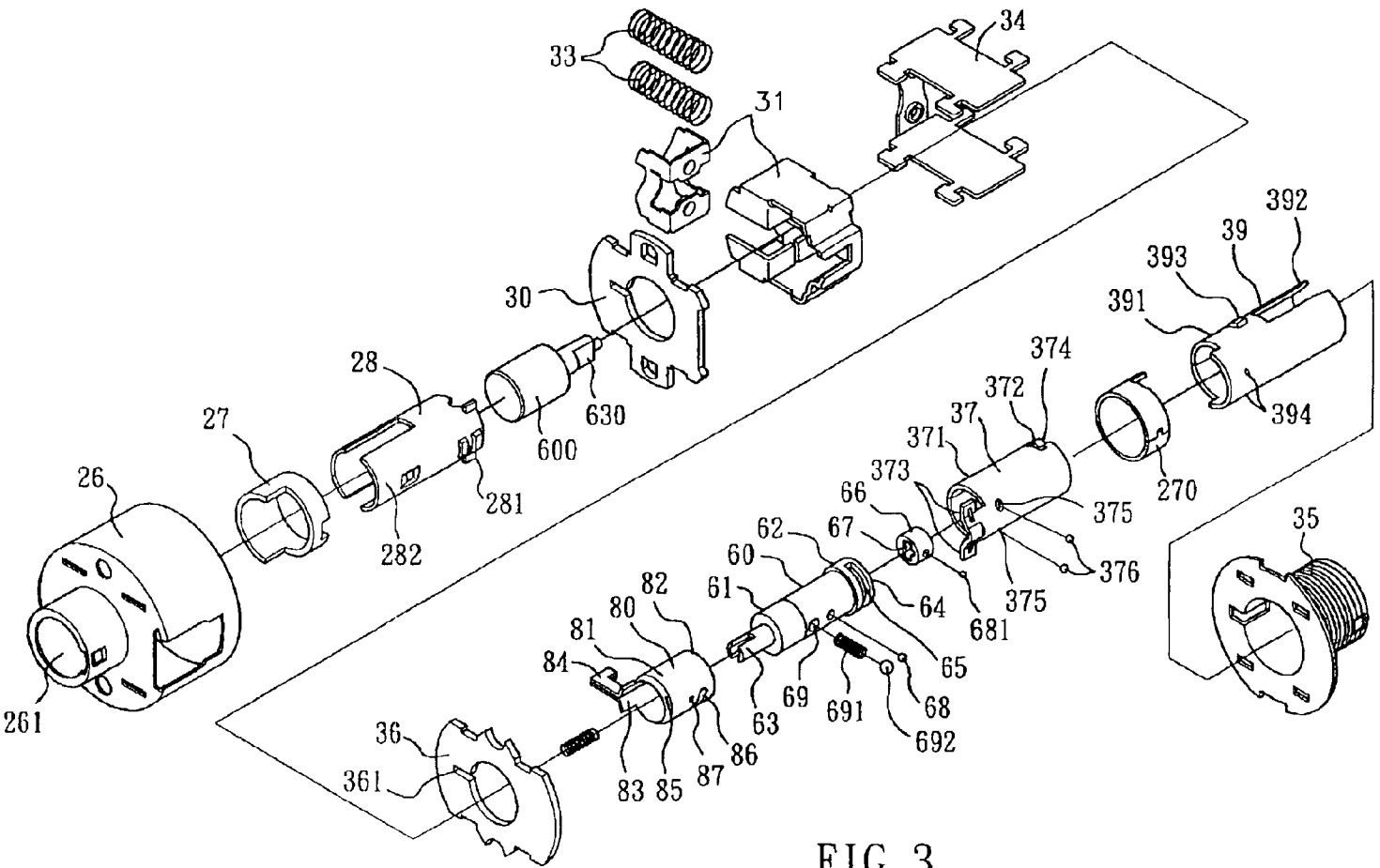
FIG. 3 is an exploded view showing the lock mechanism used in FIG. 2.
Figure 4:
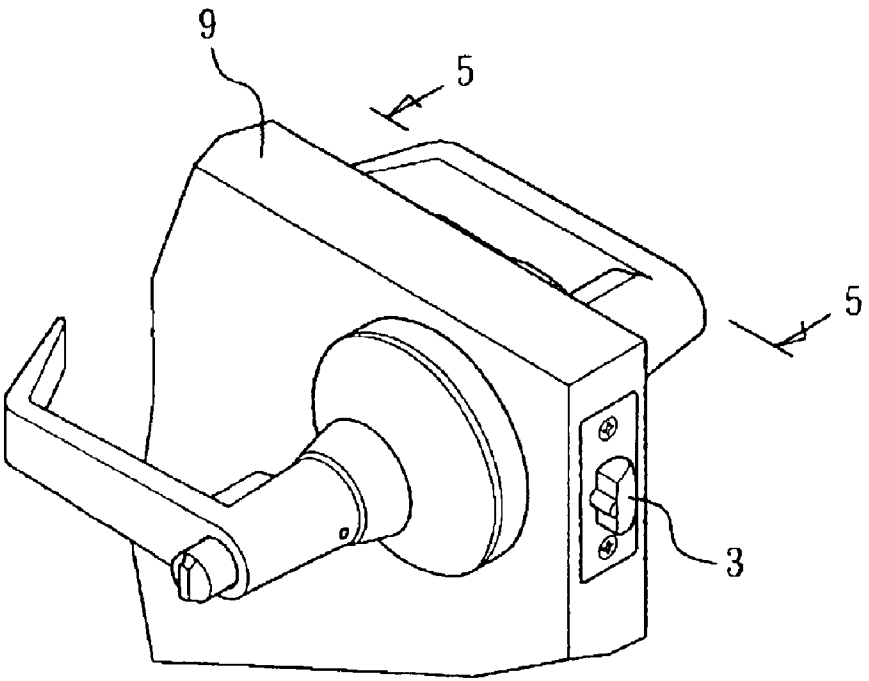
FIG. 4 is a perspective view showing the installation of the preferred embodiment of the present invention onto a door.

As shown in FIGS. 3, 5 and 7, when the rotatable component (60) is driven by the pin (681) of the connecting part (66), the pin (68) of the rotatable component (60) will be operated together with the non-axial slot (86) of the axially sliding component (80), such that the axially sliding component (80) will be shifted between the first position (as illustrated in FIG. 5) and the second position (not shown in drawings). The steel ball (692) of the rotatable component (60) is pushed by the spring (691) into one of the holes (87) of the axially sliding component (80) and retained therein, so as to allow the axially sliding component (80) to be positioned at the first position or the second position.

The key driven tube (37) comprises a pair of holes (375) each of which contains a sideway component (376), which, in the present invention, is in the form of a steel ball.

As shown in FIGS. 3 and 6, the inner peripheral wall of the first end (391) of the outer driving tube (39) is formed with two tapering holes/recesses (394) in alignment with the holes (375) of the key driven tube (37). When the lock body is locked to the first position, the exterior surface of the first end (81) of the axially sliding component (80) does not restrict the lateral movement of the sideway component (376). When the outer driving tube (39) is rotated, the tapering hole/recess (394) thereon will push the sideway component (376) into the hole (375) of the key driven tube (37) to move laterally toward the wall of the rotatable component (60). This causes the key driven tube (37) to disengage from the outer driving tube (39). By operating the operating element (71) of the lockset with a key, the connecting part (66) can be rotated for a certain angle to drive the rotatable component (60), such that the pin (68) of the rotatable component (60) can be operated together with the non-axial slot (86) of the axially sliding component (80) to enable the axially sliding component (80) to move from the first position to the second position. Accordingly, the sideway component (376) in the hole (375) of key driven tube (37) will be pushed by the guiding surface (85) of axially sliding component (80) to move laterally until it partly engages with tapering hole/recess (394). This enables the key driven tube (37) to engage with the outside driving tube (39). By rotating the outside handle (91), the outer driving tube (39) will be rotated together with the key driven tube (37). The driving wing (373) of the key driven tube (37) in turn pushes the pull-retract device (31) and releases the latch (3) to unlock the door.

Figure 8:
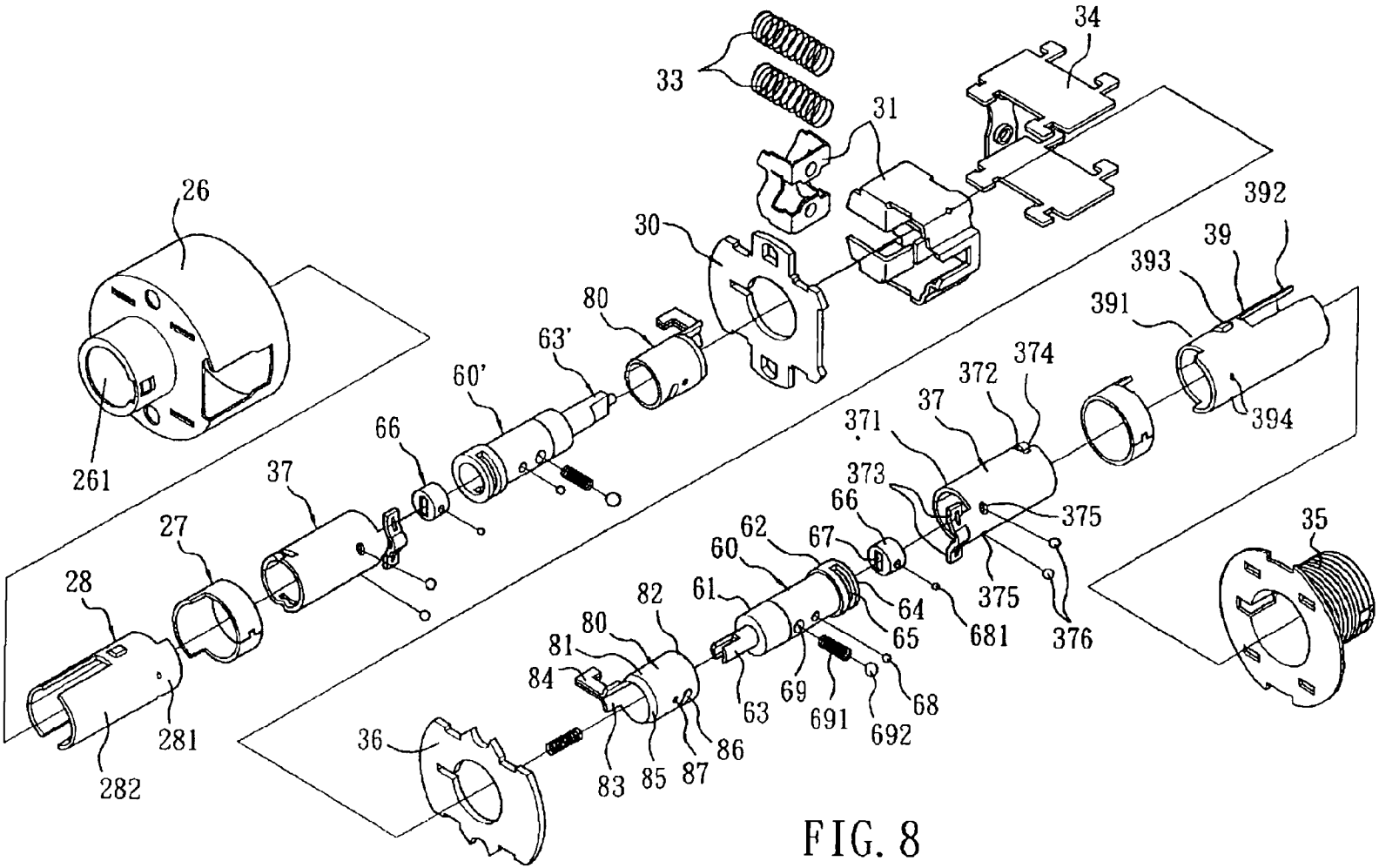
FIG. 8 is an exploded view of the lock mechanism of a second preferred embodiment of the present invention.
Figure 9:
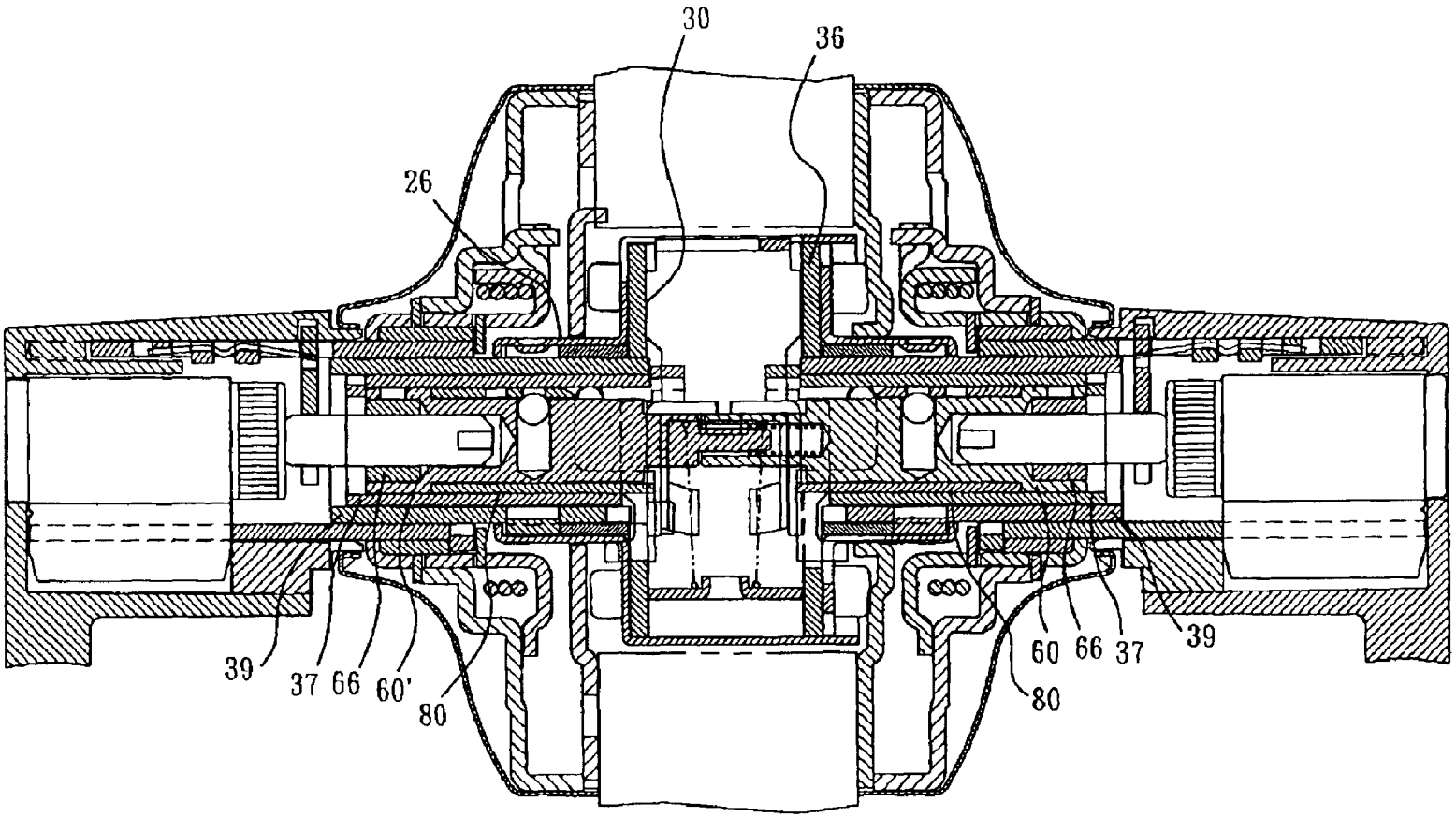
FIG. 9 is a cross-sectional view of FIG. 8 similar to that of FIG. 5.

In addition to the above-described first preferred embodiment, the present invention can also be applied to key-operated locks consisting of inside and outside locksets. As illustrated in FIGS. 8 and 9, the second embodiment of the present invention is directed to a lock body provided with inside and outside lock engaging-and-disengaging mechanisms. The operational structure and principle used in the mechanisms are generally identical to those of the mechanism of the first embodiment, with the exceptions that the connecting portions (63, 63') of the rotatable components (60, 60') of inside and outside lock engaging-and-disengaging mechanisms are provided with mutually-engaging structures, and that a spring is provided between the connecting portion (63) of the outside rotatable component (60) and the connecting portion (63') of the inside rotatable component 60' so as to maintain the axial positioning of the inside and outside rotatable components (60, 60').

All of the above are used to illustrate the preferred embodiments of the present invention, and are not intended for limiting the present invention. Any equivalent embodiment of other simple variations made according to the structure, features, spirit and the claims of the present invention should all be included within the scope of the following claims.

What is claimed is:

1. A lock engaging-and-disengaging mechanism, comprising:

a driving tube shaped into a hollow tubular body and comprising a first end and a second end, said first end being received in a lock mechanism, and said second end being connected to a handle, arid comprising at least one tapering hole on an inner wall of said driving tube;

a key driven tube shaped into a hollow tubular body comprising a first end and a second end, said key driven tube being flexibly installed to an inner tube portion of the first end of said driving tube, wherein a wall of said key driven tube is formed with at least one hole;

a sideway component for installation in said at least one hole of said key driven tube, said sideway component being either engaged with or disengaged from the tapering hole/recess of said driving tube;

an axially sliding component for insertion in the first end of said key driven tube, said axially sliding component comprising a first end, a second end, and a non-axial slot between said first end and said second end of the axially sliding component, wherein the sideway component is adjacent said first end of said axially sliding component;

a rotatable component for insertion in said axially sliding component, said rotatable component comprises a first end, a second end; a pin between said first end and said second end said pin being adaptable to extend into the non-axial slot of said axially sliding component; an axial opening formed on said second end thereof; and an arcuate slot formed on a tube wall of the second end thereof, said arcuate slot communicating with said axial opening; and a connecting part for installation into the axial opening of said rotatable component, said connecting part comprising a pin provided to a wall thereof, said pin extending into the arcuate slot of said rotatable component, said connecting part comprising a thru hole into which an operating component of a lockset can be inserted, such that said connecting part is capable of rotating said rotatable component after being rotated for a present angle by the operating component;

whereby by rotating the rotatable component, the pin of said rotatable component is operated together with the non-axial slot of said axially sliding component, so as to axially move the axially sliding component between a first position and a second position; such that when said axially sliding component is moved to the first position, the hole on said key driven tube is in alignment with the tapering hole on said driving tube, and that when said key driven tube is rotated by said driving tube, said sideway component is disengaged from the tapering hole of said driving tube, such that said key driven tube is disengaged from said driving tube;

and when said axially sliding component is moved to said second position, said sideway component is shifted into the hole of said key driven tube and the tapering hole of said driving hole, with an outer peripheral wall of said first end of said axially sliding component, said key driven tube and said driving tube being engaged with each other, such that said key driven tube is rotatable by rotation of said driving tube.

2. The lock engaging-and-disengaging mechanism as claimed in claim 1, wherein said axially sliding component further comprises a guiding surface shaped with an inclining surface around the outer peripheral wall at the first end thereof for pushing the sideway component in the hole of key driven tube to move laterally until the sideway component partly engages with tapering hole/recess to engage the key driven tube with the outside driving tube.

* * * * *

UNITED STATES PATENT AND TRADEMARK OFFICE

CERTIFICATE OF CORRECTION

PATENT NO. : 6,935,148 B2
DATED : August 30, 2005
INVENTOR(S) : Lan-Kun Don

It is certified that error appears in the above-identified patent and that said Letters Patent is hereby corrected as shown below:

Title page,
Item [73], Assignee, should read -- Tong Lung Metal Industry Co., Ltd. --.

Signed and Sealed this

Thirty-first Day of January, 2006

JON W. DUDAS
*Director of the United States Patent and Trademark Office*